US010125491B1

(12) United States Patent
McDonald

(10) Patent No.: US 10,125,491 B1
(45) Date of Patent: Nov. 13, 2018

(54) MOUNTING TRACKS WITH THERMAL BREAK AND JIG SYSTEM FOR INSTALLATION

(71) Applicant: BamCore LLC, Windsor, CA (US)

(72) Inventor: William D McDonald, Windsor, CA (US)

(73) Assignee: Bamcore LLC, Winsor, CA (US)

( * ) Notice: Subject to any disclaimer, the term of this patent is extended or adjusted under 35 U.S.C. 154(b) by 0 days.

(21) Appl. No.: 15/275,716

(22) Filed: Sep. 26, 2016

(51) Int. Cl.

| | |
|---|---|
| ***E04B 1/76*** | (2006.01) |
| ***E04C 2/34*** | (2006.01) |
| ***E04C 2/38*** | (2006.01) |
| ***E04B 2/00*** | (2006.01) |
| ***E04C 2/40*** | (2006.01) |
| ***E04B 1/80*** | (2006.01) |

(52) U.S. Cl.
CPC ..... *E04B 1/76* (2013.01); *E04B 1/80* (2013.01); *E04C 2/34* (2013.01); *E04C 2/38* (2013.01); *E04C 2/40* (2013.01); *E04C 2/46* (2013.01); *E04B 2001/7679* (2013.01); *E04C 2002/3488* (2013.01)

(58) Field of Classification Search
CPC ..... E04B 1/76; E04B 1/80; E04B 2001/7679; E04C 2/46; E04C 2/38; E04C 2/34; E04C 2/40; E04C 2002/3488
USPC ..... 52/241, 717.02, DIG. 1
See application file for complete search history.

(56) References Cited

U.S. PATENT DOCUMENTS

| | | | | | |
|---|---|---|---|---|---|
| 2,078,491 | A * | 4/1937 | Graham | E04B 2/7854 | 52/241 |
| 3,319,330 | A * | 5/1967 | Patry | B21D 39/02 | 156/202 |
| 4,052,828 | A * | 10/1977 | Mancini | E04B 2/7409 | 52/242 |
| 4,224,774 | A * | 9/1980 | Petersen | E04B 2/707 | 52/309.14 |
| 4,914,879 | A * | 4/1990 | Goldberg | E04B 1/14 | 52/242 |
| 5,209,036 | A * | 5/1993 | Cancilliari | E04B 1/2604 | 52/309.4 |
| 5,720,144 | A * | 2/1998 | Knudson | E04C 3/07 | 29/416 |
| 5,860,265 | A * | 1/1999 | Knudson | E04C 3/07 | 29/509 |

(Continued)

*Primary Examiner* — Adriana Figueroa
(74) *Attorney, Agent, or Firm* — Steven A. Nielsen; www.NielsenPatents.com

(57) ABSTRACT

The installation of panelized wall systems requires the use of connection tracks to both align and hold the panels in the precise location according the specification provided in the structural engineered plans. Some panelized wall systems are comprised of two panels disposed in a parallel position so as to define a wall cavity to contain plumbing, other utilities and insulation. In the prior art, connection tracks are made of one monolithic piece, which has the unfortunate characteristic of transferring thermal energy from one side of the connection track to the other. Disclosed embodiments break the thermal bridge of the prior art while maintaining the structural integrity of the prior art embodiments. While the disclosed connection tracks achieve desired thermal properties, they present new challenges in installation. A disclosed jig and corner installation system is required to install the disclosed connection tracks in a precisely parallel position to each other.

10 Claims, 6 Drawing Sheets

(56) References Cited

U.S. PATENT DOCUMENTS 6,125,608 A * 10/2000 Charlson ..... E04B 1/7604
52/404.1
6,250,042 B1 * 6/2001 Rudd ..... E04C 3/292
52/376
6,910,311 B2 * 6/2005 Lindberg ..... E04C 3/07
52/588.1
8,733,061 B1 * 5/2014 McDonald ..... E04C 2/16
52/300
9,523,197 B2 * 12/2016 Sessler ..... E04B 2/7457

* cited by examiner

MOUNTING TRACKS WITH THERMAL BREAK AND JIG SYSTEM FOR INSTALLATION

BACKGROUND OF THE INVENTION

(1) Field of the Invention

The invention generally relates to the installation of panelized wall systems to achieve building code required structural performance while maximizing the thermal efficiency of the entire wall system. More particularly, the invention relates to the installation and structural connection of panelized wall systems to overcome the thermal bridging that is inherent in any and all steel based connections.

(2) Description of the Related Art

The superior qualities of studless load bearing wall systems or other wall systems using bamboo panels or other types of panels are well documented and discussed in U.S. Pat. No. 8,161,697 (the '697 patent) issued to McDonald on Apr. 24, 2012. While the prior art does disclose efficient and economical means of securing studless walls having an inner and outer panel, there is room for improvement with respect to reducing thermal transfer across the wall system. In the prior art, monolithic channel elements (See FIG. 7 and FIG. 10 of the '697 patent) effectively embed an undesired thermal bridge across the wall system because of the continuous presence of the thermally conducting metal connection track across the entire wall profile. The invention that solves this undesired thermal transfer of the connection track, itself, requires a second invention to allow the invented guide track to be installed. Specifically, the installation invention takes advantage of the room in the art for improvement in the means and methods of aligning the connection tracks during the construction process. Wall panel placement must be precisely parallel and properly located and oriented in a manner that is true to the intended layout of the overall framing system. The installation invention achieves the installation requirements.

BRIEF SUMMARY OF THE INVENTION

The disclosed embodiments overcome shortfalls in the related art by presenting an unobvious and unique configuration and use of split panel connection tracks to secure or connect panels and to minimize thermal transfer through the wall cavities found between panelized walls. The disclosed embodiments present novel and unobvious means and methods that simultaneously break the undesirable thermal bridge while embedding non-thermally conducting materials where structural integrity would otherwise be lost when the thermal bridge is broken. Disclosed installation connection systems or track systems are configured for both wood based subfloors and concrete slab foundations. Various top connection systems are also disclosed. The disclosed installation connection systems or track systems have achieved unexpectedly favorable results in reducing thermal transfer as comparted to the prior art. In independent studies, 4 to 5 percent improvements have been measured with respect thermal transfer. Independent studies have also verified that the disclosed single connection or track systems result in wall panels systems with superior shear and compression strength. Thus, the disclosed embodiments break the thermal transfer of the prior art but yet provide the necessary structural support for buildings to maintain building code compliance.

For wood subfloor applications, two independent connection tracks may be used to secure two wall panels. Each connection track may comprise an outer flat portion, a rib portion and an inner flat portion. The rib may be used to fill or key into a longitudinal center void or slot of a wall panel. Each independent connection track may have a longer inner flat member as compared to a respective outer flat member, with such a configuration having the advantage of providing ample room to accept additional fasteners within the inner flat members, so as to maximize plumbing space between the panels. In some embodiments the outward flat member may sit flush with a panel while the inward flat member extends past the panel, leaving room for fasteners away from the panel. Placing fasteners directly below a panel could change the elevation of the panel, which could take the framing system out of square.

For concrete subfloor applications, special challenges are encountered with respect to fastener placement and thermal transfer. Thus, the disclosed embodiments include a unique thermal break hold-down system that provides needed structural support/attachment for the two independent connection tracks and an effective thermal barrier. The disclosed thermal break hold-down system uses fiberglass and a unique hold down washer system, wherein one long run of fiberglass may be disposed between the connection tracks or smaller squares of fiberglass may be strategically disposed between the connection tracks. Various lengths of fiberglass are contemplated for the disclosed thermal break hold-down system.

The unique combination of the extruded fiberglass connection member and unique hold-down washer or hold-down system provides the needed physical connection between the two connection tracks but yet achieves unexpectedly favorable results in reducing thermal transfer between panelized wall systems used in concrete subfloor applications. Disclosed embodiments aptly overcome the challenges of using bamboo based wall panels and other panelized wall systems on concrete subfloors and have been proven, in independent studies, to exceed the thermal properties of the prior art while providing needed structural support.

In the art of connection, securing or retaining the top edges of wall panels, the disclosed embodiments include two independent connection tracks with each connection track comprising a rib component attached to a shorter outer horizontal member and a wider inner horizontal member. In a first embodiment, to provide the needed support for the top portions of the panels, the two upper independent connection tracks may be secured to one another by use of a relatively wide fiberglass center piece attached to the two inner members by use of rivets. In a second embodiment, a relatively narrow run of fiberglass is disposed in an off center position with one of the inner horizontal members in an extended configuration to reach an outer edge of the narrow run of fiberglass. The disclosed single connection track embodiments used for top edges of panels present significant improvements in the prior art, as the disclosed riveted fiberglass is far stronger than the span of sheet metal used in the prior art. Independent lab tests have shown that the disclosed top connection track systems provide unexpectedly favorable results in shear and compression strength. In many applications, a run of fiberglass may span the entire length of the panel system to provide needed structural strength.

The disclosed split track or single connection track systems present new challenges in installation as each connection track must be set in parallel and both connection tracks must comport to the overall layout scheme of the construction. In the prior art's use of single connection systems, both tracks are mechanically connected and hence always parallel. With the disclosed embodiments, the tracks are split or separate which creates a new challenge in setting the connection tracks in a parallel position. Thus, new jig systems, as disclosed herein, are required to properly align and position the disclosed single track connection systems. Setting the positions by eyesight for the disclosed single connection tracks is inadequate and fails to adequately position the tracks in place. The disclosed embodiments include new jig or set systems that both aligns and secures the disclosed single connection track system in place.

The disclosed jig systems may comprise a handle attached to a spin shaft, with the spin shaft attached to a gear system retained within the body of the jig system. The gear system may transmit rotational movement of the spin shaft to adjust the position of a plurality of spreader bars. Each spreader bar may be pivotally attached to track block and each track block may be used to retain or set a connection track. The track blocks may be retained in parallel position by use of slide rods that run through the track blocks.

The disclosed jig system may comprise or be used with a corner system with the corner system comprising two elongated members held in 90 degree position. The elongated members may be attached to a lateral brace with the lateral brace defining one or more set voids, with the set voids used to temporally attach a corner system to a subfloor. With the corner system secured to the floor, connection tracks may be positioned and then fastened to the subfloor, at which point the corner system may be removed and reused.

REFERENCE NUMERALS IN THE DRAWINGS

Figure 1:
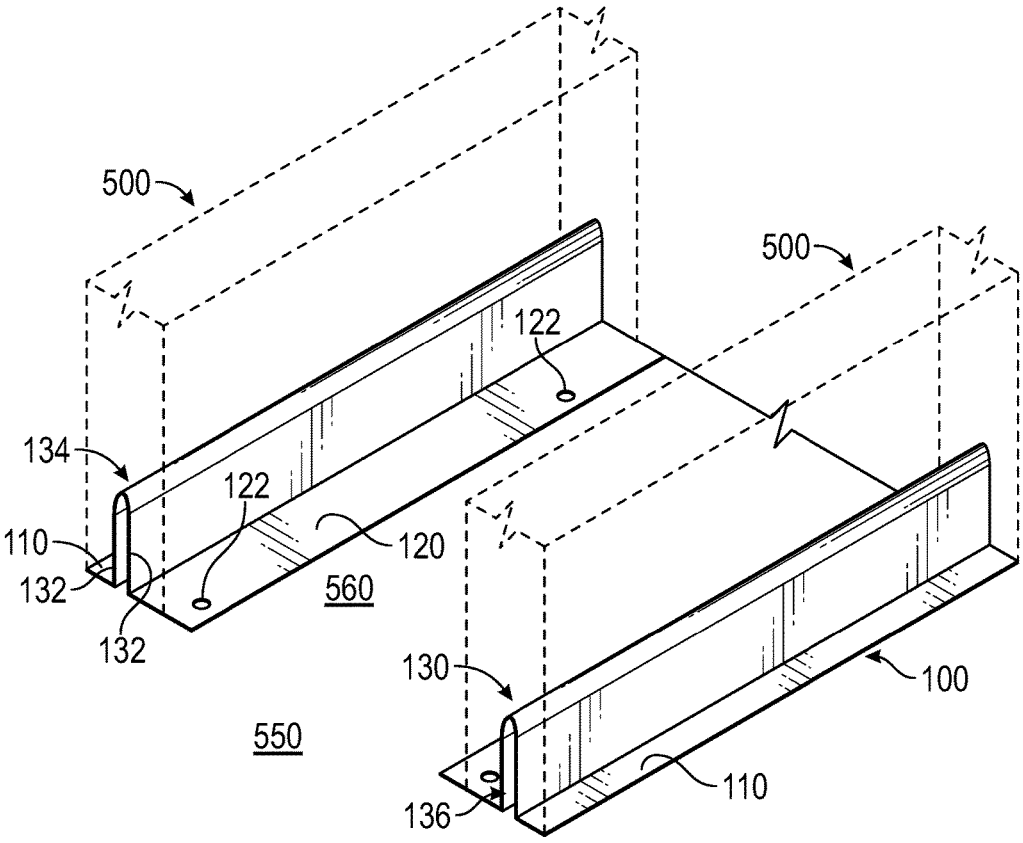
FIG. 1 depicts a perspective view of tracks used in a wood subfloor application

100 lower track in general
110 outer horizontal member of track 100
120 inner horizontal member of track 100
122 rivet secured within inner horizontal member 120
130 rib system of lower track 100
132 sidewall of rib
134 connecting arch of two rib sidewalls 132
136 connection track void defined between sidewalls 132 and arch 134
200 thermal break hold-down system
210 fiberglass run or component of thermal break hold-down system 200
220 fasteners or rivets for fiberglass component 210
230 center tie-down or anchor bolt for fiberglass component 210
240 bolt for center tie-down
300 top track in general
310 outer horizontal member of top track 300
320 inner horizontal member of top track 300
322 rivet or fastener secured within inner horizontal member 320
325 inner horizontal member in an elongated configuration
330 rib system of top connection track 300
322 rivet or fastener secured within
400 fiberglass top piece centrally disposed
425 top track system using an fiberglass top piece in an offset position
430 fiberglass top piece in an offset position
500 panel
550 wood subfloor
560 distance between panels 500
570 concrete subfloor
600 connection track jig in general
603 screw handle to adjust width of spreader bars 630 or lateral spacing bars
605 spin shaft
610 track blocks to retain tracks
620 slide rod or guide rod to guide movement of track blocks 610
630 spreader bar or lateral spacing bar to set width of track blocks 610
632 pivot system for lateral spacing bars or spreader bars 630
640 body of spacing mechanism
642 side plate
644 side plate void
646 side plate pin
650 gear rack
660 spur gear
700 corner system
702 set voids defined within a lateral brace 720
708 string pin
710 set string
720 lateral brace of corner system 700
730 elongated members of corner system set at normal or a 90 degree angle
740 spacing assembly of corner system
742 extension bar of spacing assembly
745 guide bar of spacing assembly These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

Referring to FIG. 1, a lower track system 100 is shown as inserted into a panel 500 with the lower track system comprising an rib 130 attached to an outer horizontal member 110 and an inner horizontal member 120. The disclosed tracks, such as a lower track system 100 or upper track system discussed below and shown in FIG. 3, overcome shortfalls in the art by several means, including the absence of a bridge or direct connection between an outer track and an inner track. A rib 130 may comprise two side walls 132 connected by an upper arch 134 with the two sidewalls being substantially parallel to one another. This configuration defines a connection track void 136 that may be used to secure flashing or other useful construction components.

The system of FIG. 1 may be used for a wood subfloor 550 application or other applications. In order to achieve more contact area or area for rivets 122 or other fasteners, the inner horizontal member 120 may be of greater width as compared to the outer horizontal member 110. With such a configuration, or relative horizontal member lengths, panels 500 may be disposed in a more outward position to maximize pluming space 560 or the distance between the panels. The hollow shape of the rib system 130 overcomes shortfalls in the art by presenting a fin or rib 130 that may be inserted into a center void of a panel.

Figure 2:
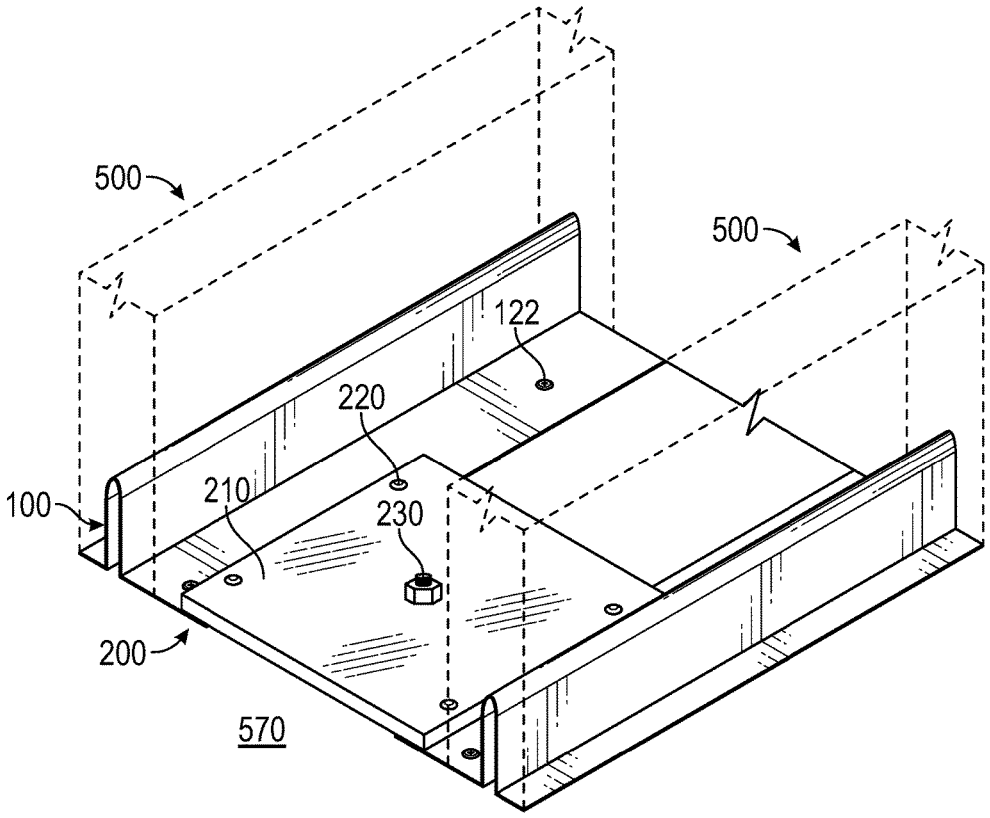
FIG. 2 depicts a perspective view of tracks and a fiberglass hold-down system used in a concrete subfloor application

FIG. 2 depicts a concrete subfloor 570 application wherein two lower track systems 100 are secured to a concrete subfloor directly by use of rivets 122 or fasteners through the inner horizontal member and into the concrete subfloor 570. In order to overcome the challenges of thermal transfer and effective attachments within a concrete subfloor, a new fiberglass thermal break hold-down system 200 is used to further secure the lower tracks and to provide a thermal barrier. A fiberglass run 210 or component may be attached to the concrete subfloor by use of an anchor bolt 230, and bolt 240. The disclosed fiberglass thermal break hold-down system 200 overcomes shortfalls in the prior art by minimizing the number of anchor bolts that need to be set and glued into the concrete subfloor by the artful use of a fiberglass component 210 that bridges over to each track, moreover, the fiberglass component 210 may contain or retain a plurality of fasteners or rivets 220 that penetrate through each of the inner horizontal members 120. Thus the center hold-down bolt of the fiberglass component is leveraged such that fasteners at the outer edges of the fiberglass component provided adequate hold-down forces. In the configuration shown in FIG. 2, the fiberglass component 210 may be considered or used as a washer with respect to the anchor bolt or center tie-down 230. The fiberglass component may take the form of a relatively square washer as shown in FIG. 2 or may span the entire length of the panel wall system. The disclosed hold-down system helps to keep the panel wall system in place during an earthquake while decreasing thermal transfer between the connection tracks.

Figure 3:
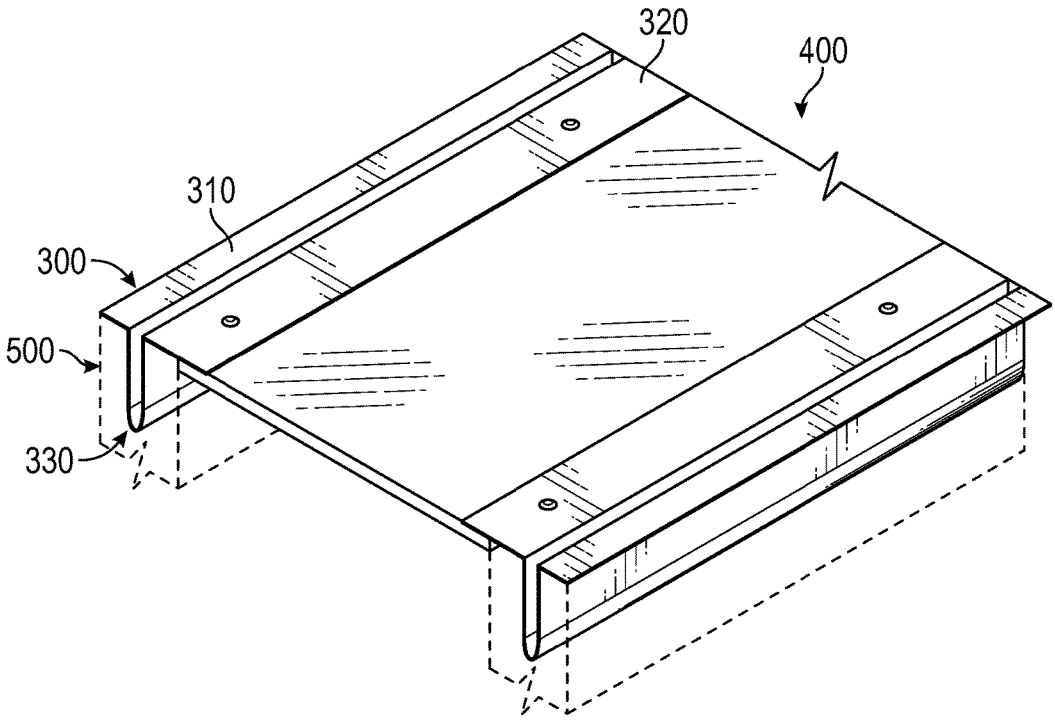
FIG. 3 depicts a perspective view of a top track system with a centered fiberglass run

FIG. 3 depicts two top track systems 300 attached together by use of a centrally disposed fiberglass top piece 400. The fiberglass top piece overcomes shortfalls in the prior art by breaking the thermal bridge of the prior art while keeping the two top tracks in a parallel position and providing superior structural integrity to the panelized wall system.

Figure 4:
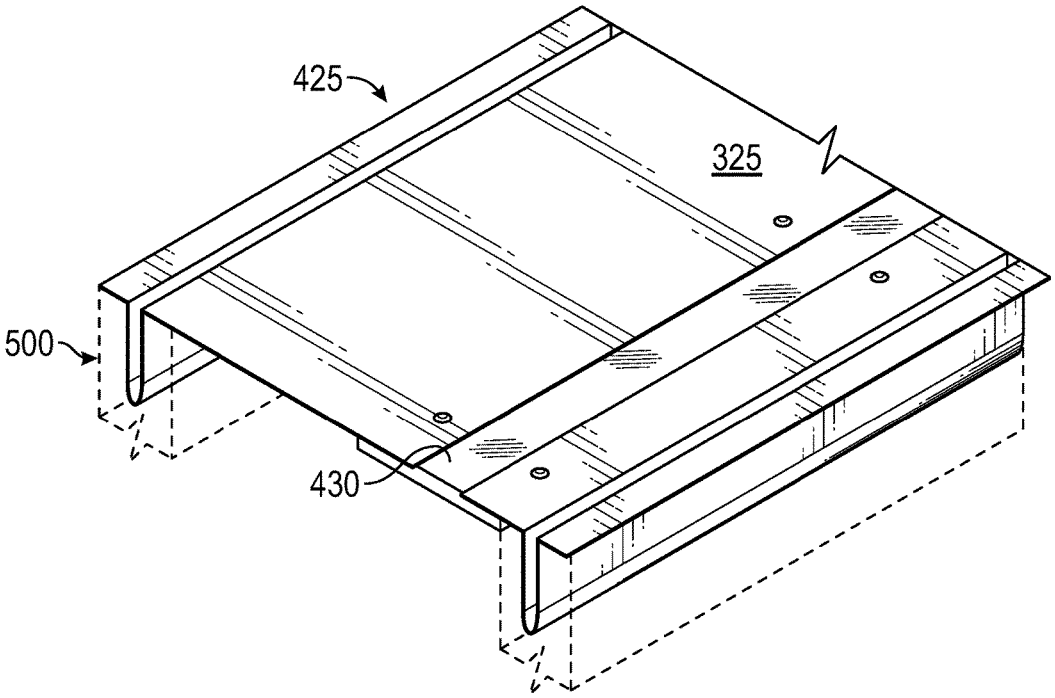
FIG. 4 depicts a perspective view of a top track system with on off centered fiberglass run

FIG. 4 depicts an offset or asymmetric top track system 425 wherein one top track has an elongated or widened horizontal member 325 so as to minimize the width of the fiberglass top piece 430 disposed in an offset position. This configuration overcomes shortfalls in the prior art by providing a thermal break between the upper tracks using a minimal amount of fiberglass.

Top connection tracks may be installed without an installation jig, as the top connection tracks may be placed within panels previously secured and positioned from the bottom.

Figure 5:
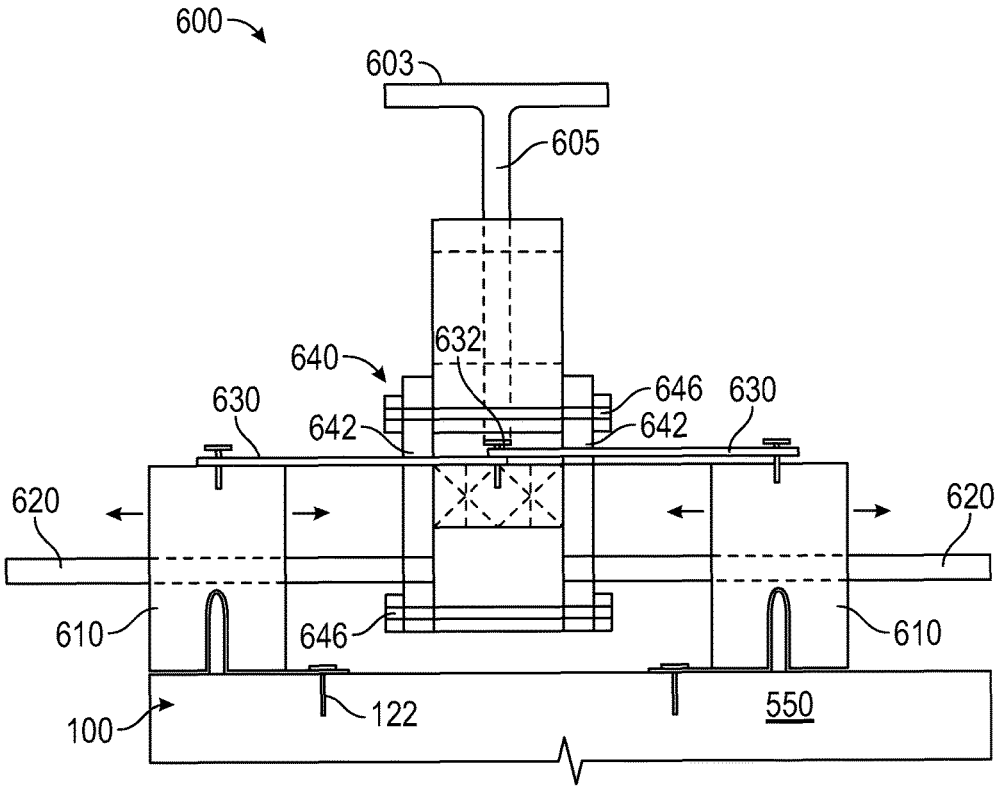
FIG. 5 depicts a sectional view of a jig system used in a wood subfloor application

FIG. 5 depicts a connection track jig 600 or track set system wherein a handle 603 may be turned to adjust the distance of spreader bars 630, with the spreader bars attached to two track blocks 610. The track blocks 610 be made of any material, but the use of Plexiglas is contemplated so as to allow for the viewing of connection tracks 100 contained within the track blocks. The handle 603 may be connected to a spin shaft 605 with the spin shaft mechanically connected to gearing with in the body 640 of the spacing mechanism. The gearing may be connected to the spreader bars 630 which in turn set the distance between the track blocks 610. The track blocks may have centrally disposed voids to accept connection tracks 100. The track blocks may be retained in a parallel position by the use of slide rods 620 that are slideably disposed within the track blocks. The spreader bars 630 may be mechanically attached to a pivot system 632, with the pivot system disposed within the body 640 of the spacing mechanism or body of the jig system.

Figure 8:
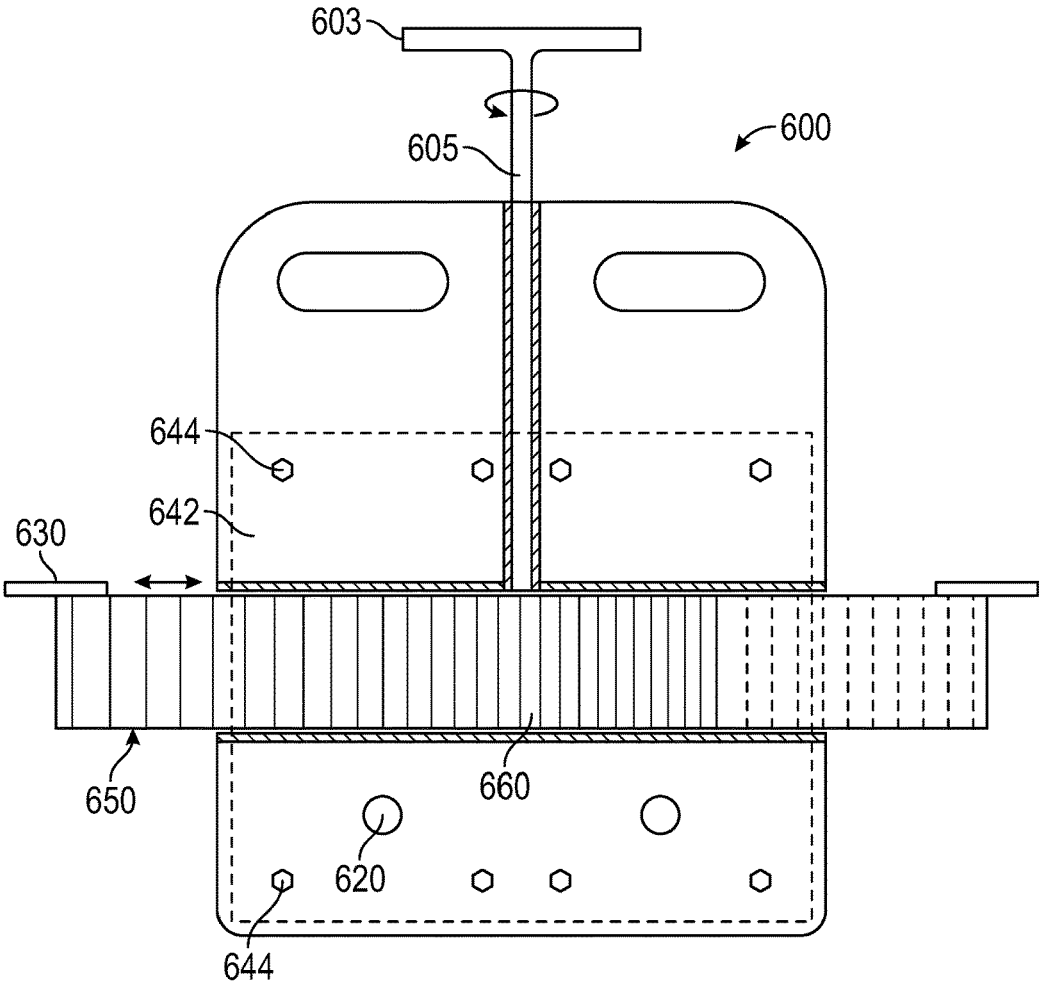
FIG. 8 depicts a sectional view of a jig system

A disclosed embodiment of a connection track jig may overcome shortfalls in the art by the use of side plates 642 secured by side plate pins 646 to define an interior space to house a gear spar, with the gear spar moving a gear rake, with the gear rake moving a spreader bar, as shown more clearly in FIG. 8.

Figure 6:
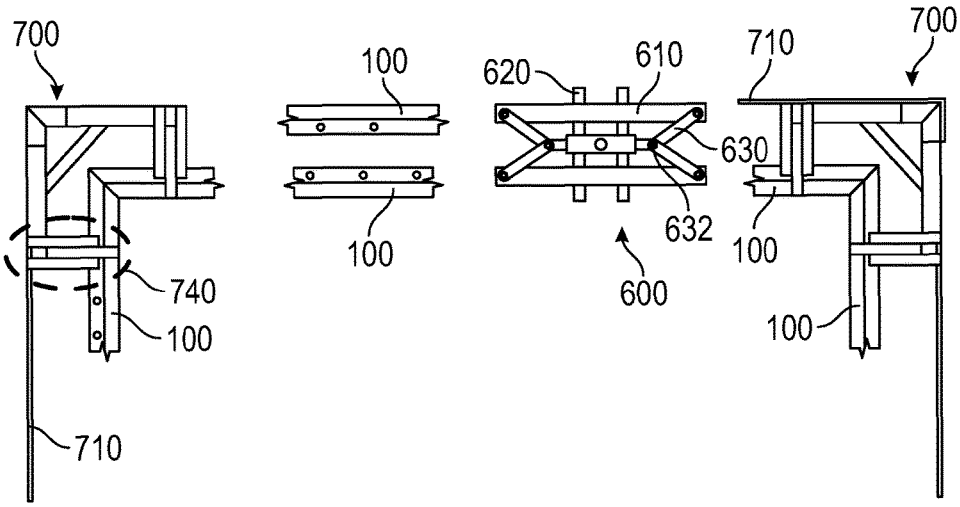
FIG. 6 depicts a top plan view of a jig system

FIG. 6 depicts a top plan view of a connection track jig 600 and corner system 700 as well as connection track systems 100, with the connection track systems disposed in a parallel position. The jig system 600 is shown with two track blocks 610 with the movement of the track blocks guided by two slide rods 620. The spreader bars 630 may be pivotally attached to the track blocks and may be pivotally attached to a centrally disposed pivot system 632.

FIG. 6 further depicts a corner system 700 used to retain or set connection tracks 100 at two corners and depicts a set strings 710 used to help set the next corner juncture. Lasers may be used in place of set strings. A corner system may comprise a spacing assembly 740 used to set a distance between the connection tracks.

Figure 7:
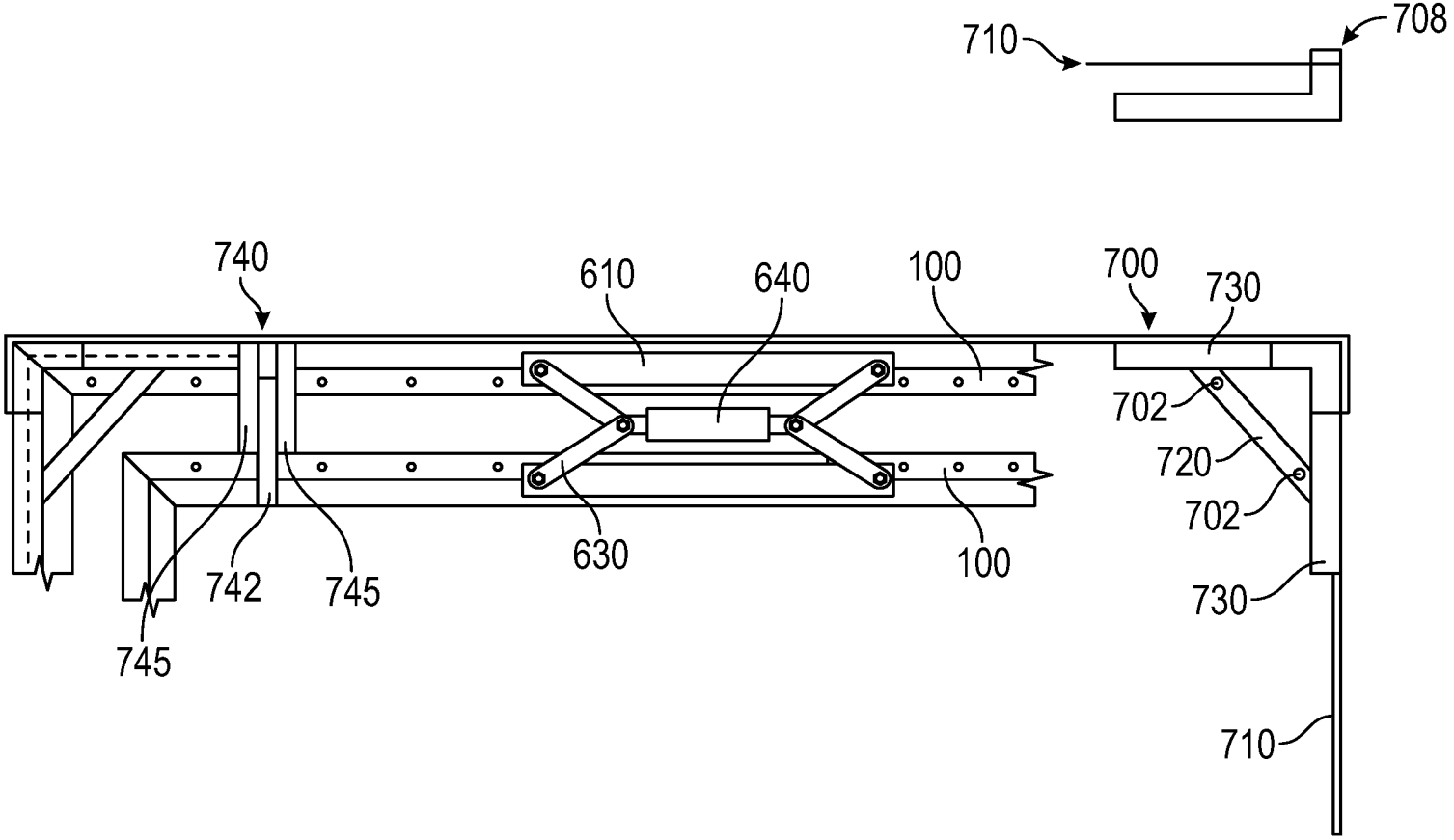
FIG. 7 depicts a top plan view of a jig system

FIG. 7 depicts a corner system 700 that may comprise a two elongated members 730 set a normal or a 90 degree angle with the two elongated members sometimes attached to a lateral member 720 with the lateral member sometimes defining one or more set voids 702, with the set voids used to receive fasteners to temporarily set the corner system in place. Once set in place, a corner system may be used to retain a connection track 100 placing the connection track in position for permanent fastening to a subfloor. After the track is fastened to the subfloor, the corner system may be removed and reused. A corner system is shown with a spacing assembly 740, the spacing assembly comprising one or more guide bars 745 used to guide or retain an extension bar 742. Different sized extension bars may be used to comport with a desired spacing between the connection tracks. The spacing assembly 740 has a mechanical advantage of being relatively compact and well suited for close in corner work.

FIG. 8 depicts sectional view of a track jig 600 having a screw handle 603 attached to a spin shaft 605 with the spin shaft sometimes connected to a gear spar 660 with the gear spar sometimes attached to a gear rake 650 with the gear rake sometimes attached to a spreader bar 630. Two side plates may help to secure the body 640 of the spacing mechanism. The side plates may define side plate voids 644 used to retain side plate pins.

Figure 9:
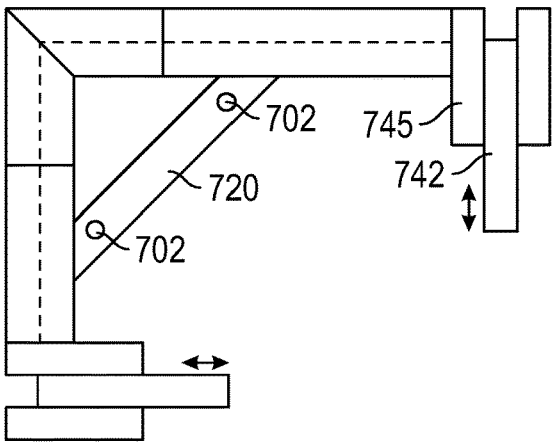
FIG. 9 depicts a top plan view of a corner system

FIG. 9 depicts a corner system without a connection track in place. A corner system may include a lateral brace 720 with the lateral brace defining one or more set voids 702.

Vigorous testing confirms the thermal efficiencies achieved by the disclosed embodiments. For example, in a base case, using a full span dual track system of the prior art, thermal transfer was measured by measuring the temperature difference between one track placed in a chilled environment (cold side) and one track placed in a warm environment (warm side). In the base case, the cold side track had a temperature of −25.7 degrees (all temperatures were measured in Fahrenheit) and an ambient temperature of 2.9 degrees and the warm side track had a temperature of 31.1 degrees with an ambient temperature of 58.1 degrees. The warm to cold difference was thus 56.8 degrees. This warm to cold temperature difference represents a base case, prior art thermal transfer of a non-split track system. Improvements in the base case will show a greater temperate difference as compared to 56.8 degrees.

In the embodiment shown in FIG. 1 a temperature difference of 103.3 degrees was measured which is an improvement of 46.5 degrees. In the embodiment of FIG. 2, a temperature difference of 87.2 was measured which is an improvement of 30.4 degrees. In the embodiment of FIG. 4, a temperature difference of 76.6 was measured which is an improvement of 19.8 degrees.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. A system for the installation and retention of a panelized wall system of two or more panel walls, the panel walls disposed in a parallel position, the system comprising:

a) a first connection track (100) and a second connection track, with both connection tracks comprising a rib system (300) with each rib system attached to an outer horizontal member (110) and an inner horizontal member (120), the rib system comprising two parallel sidewalls (132) connected by a connecting arch (134) and the parallel sidewalls and connecting arch defining a connection track void (136);

b) the first connection track disposed in parallel to the second connection;

a connection track jig (600) the connection track jig used for positioning the first and second connection tracks, the jig comprising:

b) a screw handle (603) attached to a spin shaft (605) the spin shaft connected to a spur gear (660) the spur gear connected to a gear rack (650) the gear rack attached to a first and second spreader bar (630), first and second spreader bar each connected to their respective first and second track block (610) with each track block retaining the respective first and second connection track.

2. The system of claim 1 wherein a non-thermally conductive washer (210) is secured upon the inner horizontal member of the first connection track and the inner horizontal member of the second connection track by use of fasteners secured through the washer and through the respective inner horizontal member.

3. The system of claim 2 wherein an anchor bolt (240) is attached to the washer and wherein the system is upon a concrete foundation.

4. The system of claim 1 wherein each inner horizontal member is of greater width as compared to the width of each of the outer horizontal member such that each outer horizontal member is configured to be relatively flush with an installed panel wall and wherein each inner horizontal member extends beyond the installed panel wall to accept fasteners attached beyond the installed panel wall.

5. The system of claim 2 wherein the washer is of a length to substantially cover the length of the first and second connection tracks.

6. The system of claim 1, for use upon the top of a panelized wall system (400), the system further comprising a length of non-thermally conductive material attached to the inner horizontal members of the first and second connection tracks.

7. The system of claim 6, with one of the inner horizontal members of (425) greater width as compared to the other inner horizontal member with the non-thermally conductive material disposed in an offset (430) position.

8. The system of claim 1 wherein the jig further comprising a body (640) defined by two side plates (642) with the side plates attached by use of a plurality of side plate pins (646) the side plates having inner walls containing a lower section of the spin shaft (605) and further containing a pivot system (632) the pivot system attached to the spreader bars.

9. The system of claim 8 wherein the jig further comprising one or more slide rods (620) disposed upon the body and disposed within voids defined within the track blocks.

10. The system of claim 9 further comprising a corner system (700), the corner system used to position corners of the first and second connection tracks, the corner system comprising two elongated members (730) attached to one another at a right angle, the two elongated members attached to a lateral brace (720) the lateral brace defining one or more set voids (702) the set voids used to accept fasteners that temporally hold the corner system in place.

* * * * *